US011828447B2

(12) United States Patent
Van Bommel et al.

(10) Patent No.: US 11,828,447 B2
(45) Date of Patent: Nov. 28, 2023

(54) LIGHT SOURCE COMPRISING A SUBSTRATE AND A HEAT SINK STRUCTURE

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 47 days.

(21) Appl. No.: 17/612,621

(22) PCT Filed: May 18, 2020

(86) PCT No.: PCT/EP2020/063823
§ 371 (c)(1),
(2) Date: Nov. 19, 2021

(87) PCT Pub. No.: WO2020/234241
PCT Pub. Date: Nov. 26, 2020

(65) Prior Publication Data

US 2022/0221144 A1 Jul. 14, 2022

(30) Foreign Application Priority Data

May 20, 2019 (EP) ..... 19175279

(51) Int. Cl.
*F21V 29/77* (2015.01)
*F21S 4/24* (2016.01)
(Continued)

(52) U.S. Cl.
CPC ..... *F21V 29/77* (2015.01); *F21K 9/232* (2016.08); *F21S 4/24* (2016.01); *F21Y 2103/10* (2016.08); *F21Y 2115/10* (2016.08)

(58) Field of Classification Search
CPC ..... F21V 29/77; F21V 29/78; F21V 29/713; F21V 29/74; F21V 29/745; F21V 29/75;
(Continued)

(56) References Cited

U.S. PATENT DOCUMENTS

2003/0090910 A1* 5/2003 Chen ..... H05K 1/189 362/555
2009/0135595 A1* 5/2009 Chen ..... F21K 9/232 362/249.02
(Continued)

FOREIGN PATENT DOCUMENTS

CN 205191262 U 4/2016
EP 2899459 A1 7/2015
(Continued)

*Primary Examiner* — Erin Kryukova

(57) ABSTRACT

The present invention relates to a light source (100) comprising a substrate (110) having a slit (112) and a sheet formed heat sink structure (120) comprising a plurality of LEDs (130), wherein the plurality of LEDs are arranged at a surface (122) of the heat sink structure and wherein the heat sink structure is mounted through the slit such that a LED comprising portion (124) of the heat sink structure, extending from a first side (114) of the 5 substrate, and a heat-emitting portion (126) of the heat sink structure, extending from a second side (116) of the substrate being opposite to the first side, are formed. A lighting system comprising such a light source is also presented.

12 Claims, 7 Drawing Sheets

(51) Int. Cl.
*F21K 9/232* (2016.01)
*F21Y 103/10* (2016.01)
*F21Y 115/10* (2016.01)

(58) Field of Classification Search
CPC ..... F21V 29/773; F21S 4/24; F21K 9/232; F21Y 2103/10; F21Y 2113/10; F21Y 2107/70; F21Y 2107/30; F21Y 2107/40; F21Y 2107/50
See application file for complete search history.

(56) References Cited

U.S. PATENT DOCUMENTS

2012/0201022 A1* 8/2012 van de Ven ..... F21K 9/90 362/218
2012/0201024 A1* 8/2012 van de Ven ..... F21S 4/26 362/231
2012/0287614 A1* 11/2012 Kajiya ..... F21K 9/232 362/184
2013/0058082 A1* 3/2013 Hirsh ..... F21K 9/27 362/249.02
2014/0321126 A1* 10/2014 Narag ..... F21V 21/14 362/306
2015/0198320 A1* 7/2015 Kim ..... F21V 29/713 362/294
2015/0257250 A1* 9/2015 Jeon ..... H01L 23/3672 361/720
2017/0138543 A1* 5/2017 Steele ..... F21V 9/32
2017/0248278 A1 8/2017 Van Hout
2018/0087724 A1* 3/2018 Bergenek ..... F21V 19/0025
2018/0245743 A1 8/2018 Beijer
2019/0145584 A1 5/2019 Ko et al.
2019/0212004 A1* 7/2019 Van Bommel ..... F21S 4/24

FOREIGN PATENT DOCUMENTS

WO 2013032276 A1 3/2013
WO 2013078180 A1 5/2013
WO 2016039908 A1 3/2016
WO WO-2017055115 A1 * 4/2017
WO 2018001781 A1 1/2018

* cited by examiner

LIGHT SOURCE COMPRISING A SUBSTRATE AND A HEAT SINK STRUCTURE

CROSS-REFERENCE TO PRIOR APPLICATIONS

This application is the U.S. National Phase application under 35 U.S.C. § 371 of International Application No. PCT/EP2020/063823, filed on May 18, 2020, which claims the benefit of European Patent Application No. 19175279.9, filed on May 20, 2019. These applications are hereby incorporated by reference herein.

FIELD OF THE INVENTION

The present inventive concept relates to a light source comprising a substrate and a heat sink structure suitable for general lighting applications. The present invention further relates to a lighting system comprising said light source and a socket connection.

BACKGROUND OF THE INVENTION

Light-emitting diode (LED) general lighting solutions are readily available on the market today. LEDs generally provide more power efficient lighting as well as extended lifetime compared to incandescent and fluorescent lighting. The increased power efficiency of LEDs generally correlates with reduced waste heat production. However, high lumen LED based light sources still produce waste heat and require heat management.

WO-2013/032276 discloses a lighting device having a cover, a heat sink and a light source. The cover has a bulb shape with an empty interior and an opening in a lower portion. The heat sink has a top surface and a bottom surface separated by a side surface. The top surface of the heat sink has a shape corresponding to the opening of the cover. A member is disposed on the top surface of the heat sink so that it extends through the opening into the interior of the cover. The light source is attached to the member, so that it is also located in the interior of the cover. The light source has a substrate with light emitting devices mounted thereon.

EP-2899459 discloses an LED lamp that is formed by combining an external radiating body with an internal radiating body. The bottom of the internal radiating body is connected with an LED display panel. The top of the external radiating body is connected with a lamp interface and power supply box. A combined and discontinuous multilayer three-dimensional radiating structure consisting of a plurality of radiating fins is disposed on the top of the internal radiating body. A hollow cavity is formed between the adjacent radiating fins.

WO-2013/078180 discloses an article having a flexible circuit with a polymeric dielectric layer having first and second major surfaces. One or both of the first and second major surfaces have a conductive layer thereon. At least one conductive layer has an electrical circuit configured to power one or more light emitting semiconductor devices located on the flexible circuit. The flexible circuit is shaped to form a three dimensional structure.

At elevated temperatures LEDs show lower efficiency and thus their luminous flux decreases. In some cases, as a result of elevated temperatures, color shift to a different wavelength can occur. Furthermore, during prolonged exposure to elevated temperatures the lifetime of the LEDs may decrease drastically. With these issues in consideration, it is clear that there is room for improvement within the technical field.

SUMMARY OF THE INVENTION

It is an object of the present invention to overcome at least some of the abovementioned problems.

According to a first aspect, a light source is provided. The light source comprises a substrate having a slit, and a sheet formed heat sink structure comprising a plurality of LEDs. The plurality of LEDs is arranged at a surface of the heat sink structure. The heat sink structure is mounted through the slit such that a LED comprising portion of the heat sink structure, extending from a first side of the substrate, and a heat-emitting portion of the heat sink structure, extending from a second side of the substrate being opposite to the first side, are formed.

LEDs are devices that emit light or photons by electroluminescence. Out of a plurality of different technologies, solid state inorganic LEDs are arguably the most common type. Such LEDs may present the most promising option for many applications due to the advanced stage of the technology and cost effective manufacturing. Highly efficient blue LEDs with phosphor coatings may be utilized to mimic the visible light spectrum of the Sun and incandescent light sources thus, making LEDs viable for general lighting.

By having the LEDs arranged at the surface of the heat sink structure waste heat may be provided with a way to escape the LEDs and spread out into the heat sink structure where it gets dissipated. It should be understood that the wording "arranged at the surface" may mean "arranged on the surface". LEDs may be separate to the heat sink structure or substantially integrally formed with it. LEDs may be arranged to feature a large interface area towards the heat sink structure for increased heat transfer. The heat sink structure may typically provide even larger surface areas for dissipating the heat into any surrounding medium, be it air, gaseous, liquid or even solid. It should be noted that all parts of the heat sink structure, and not just the heat-emitting portion, may serve to dissipate heat to a surrounding medium.

The suggested LED arrangement further provides a possibility to bring more LEDs into a smaller area while providing cooling due to the three-dimensional geometry of the device. This may provide a device with a higher light output from the same substrate surface area, i.e. with a higher light density. For example, a substrate with a diameter of 50 mm may have a light output of 1000 lumen. In turn this light density improvement may enable a reduction of at least some device dimensions while maintaining a similar light output. Furthermore, this approach to heat dissipation may provide a low complexity, easily scalable device requiring relatively few components.

The slit, and thus also the heat sink structure, may be meander shaped or spiral shaped or star shaped.

By the wording "meander shaped" it is implied that the heat sink structure sheet and the slit of the substrate meanders, i.e. that it alternately folds inwards and outwards as seen from a direction normal to the substrate or perhaps more specifically a direction normal to a surface of the first and second side of the substrate. Inwards and outwards folds need not have equal radius nor length. Folds may be spaced or directly consecutive. Folds may not need to alternate 1:1 inwards-outwards. A feature that is meandering may only need to exhibit a regular meander shape, according to the above definitions, for portions of that feature. By the wording "spiral shaped" it is implied that the heat sink structure sheet and slit of the substrate spirals, i.e. that it continuously folds inwards with a slight but continuous decrease or increase to the radius of the fold.

These shapes enable efficient area spacing of the heat sink structure. They also reduce complexity as a single sheet may be used for the heat sink structure.

The slit, and thus also the heat sink structure, may be meander or star shaped and comprise at least 3 folds, preferably at least 5 folds and more preferably at least 7 folds.

The slit, and thus also the heat sink structure, may be spiral shaped and comprise at least 3 loops, preferably at least 5 loops and more preferably at least 7 loops.

By the wording "loops" it is implied that heat sink structure sheet and the slit of the substrate spirals a number of rotations around a center for the spiral shape. One rotation around the center constitutes one loop. Both meander and spiral shapes may enable a larger area for LED placement and heat dissipation. Meander shapes may feature less substrate material cantilevering, to the benefit of the substrate's structural integrity. Spiral shapes may be less complex to produce and easier to attach LEDs to because of the generally larger radius folds. Star shaped heat sink structures may provide similar advantages as the meandering shapes in regard to substrate structural integrity.

The heat sink structure may be formed by a bendable metal or a graphite sheet.

By the wording "bendable" it is implied that the material may be folded or bent to match the folds of the substrate slit. The wording further refers to folding of material resulting in both elastic and plastic deformation. The wording "formed" may in this context be understood as "comprising". The heat sink structure may be part of a printed circuit board (PCB) such as a metal core PCB (MCPCB). It may also be a sheet metal such as an aluminum or copper sheet or a highly conductive graphite sheet. LEDs may be mounted on a strip and glued on top of the sheet metal or graphite.

The use of metal may be ideal for the heat sink structure as many metals are easy to form as thin sheets. Metals generally also feature high thermal conductivity which may increase the amount of heat dissipated by the structure. Increased thermal conductivity may be favorable as it allows faster and more even spread of heat into the heat sink structure. In turn this may improve heat transfer from the LEDs, as waste heat produced by the LEDs may quickly spread out though the heat sink structure. Heat transfer towards the surrounding medium may also increase as heat will more easily spread into all corners of the heat sink structure, allowing more efficient utilization of the heat sink structure area.

At least part of the heat-emitting portion of the heat sink structure may be bent towards the substrate.

By the wording "bent" it is implied that the heat sink structure is bent substantially 90 degrees towards the substrate upon extending out of the slit of the substrate. Thus, the bent portions of the heat sink structure extend in a plane parallel to the substrate or its surfaces.

Bending parts of the heat-emitting portion of the heat sink structure post assembly towards the substrate may serve to reduce the volume use of the heat-emitting portion when geometrical dimensions constitute a more limiting factor than efficient heat dissipation. The structural integrity and fixation of the heat sink structure may also be improved by folding the heat-emitting portion towards the substrate. Additionally, it is also possible that the structural integrity of the substrate may be favorably affected by bending the heat sink structure towards the substrate.

Similarly, at least part of the LED-comprising portion of the heat sink structure may be bent towards the substrate. This may also conserve space and be beneficial for light output optimization when used in conjunction with top-emitting LEDs.

The plurality of LEDs may be arranged proximate to an edge of the LED comprising portion of the heat sink structure.

By arranging LEDs proximate to the far edge of the LED comprising portion of the heat sink structure in relation to the substrate, a clearer heat flow distribution may be achieved. This way, heat may more predictably flow from the far edge of the LED comprising portion to the far edge of the heat-emitting portion.

The plurality of LEDs may be side-emitting LEDs.

Since LEDs are typically arranged perpendicular to the substrate on the surface of the heat sink structure improvements in light output and efficiency may be achieved by using primarily side-emitting LEDs. LEDs may be aligned to primarily emit along the normal extending out from the first side of the substrate. This way less light may be lost from interaction with the substrate and the heat sink structure as well as other features.

The substrate may comprise a plurality of slits and wherein the heat sink structure may comprise a plurality of protrusions, the protrusions being adapted to extend through the slits of the substrate.

Instead of using a single slit, which may hamper the structural integrity of the substrate if the slit is long enough, multiple slits may be considered. By creating a heat sink structure with multiple protrusions to match the slits, the LED comprising portion may remain unchanged. The protrusions may correspond to the heat-emitting portions. The use of a plurality of protrusions and slits may additionally improve fixation of the heat sink structure to the substrate. As implied, another advantage of several slits may be a more structurally robust substrate. This may be due to the substrate being more integrally connected, with less of it acting as a cantilever, than if longer single slits are used. Protrusions of the heat sink structure, and more specifically of the heat-emitting portion, may be easier to bend towards the substrate.

The first side of the substrate may comprise a light reflective surface.

A light reflective surface on the first side of the substrate, facing the LEDs, may reduce the extent to which light from the LEDs is absorbed by the substrate and thus increase the light output of the light source. More light may be directed out of the light source. A light reflective surface may lead to less heating of the light source.

The light source may further comprise a housing consisting of the substrate, an outer side wall, and a cover, wherein the LED comprising portion of the heat sink structure is housed within the housing for forming a light mixing chamber.

By enclosing the LEDs and the LED comprising portion of the heat sink structure, to form a so called light mixing chamber, a more controlled environment may be achieved. If enclosed and sealed, the light mixing chamber may for example be filled with a specific gas or a vacuum. Such a controlled environment may for example be used to alter LED light output characteristics such as color. Heat dissipation from the heat-emitting portion of the heat sink structure, not enclosed by the housing, may also benefit from a controlled environment on the other side of the substrate. By creating a less thermally conductive environment internally in the housing, a larger portion of the waste heat generated may have to dissipate through the heat sink structure, away from the LEDs, to the heat-emitting portion. LEDs may suffer less thermal stress as a result, improving their longevity. The housing may further be beneficial as may protect the LEDs and potential associated electronic components from an outer environment that could be detrimental to the device performance and longevity.

The housing may further give the light source a more even illumination profile. This may be put in contrast to if LEDs would be exposed and provide a plurality of very bright, discrete point sources of light. The cover may also be adapted to alter the color or spectrum of the output light. The cover may be at least partially light transmissive. This could mean being substantially fully transparent for light but also only marginally so. Separate parts of the light source may comprise a polymer material. Polymer materials to be considered may include polycarbonate, polyethylene terephthalate, acrylonitrile butadiene styrene, polylactic acid, high-density polyethylene, polyphenylsulfone, high impact polystyrene, polytetrafluoroethylene and other fluoropolymers. The parts may be formed by fused deposition modelling (FDM). FDM is a rapid prototyping technology. Other terms for FDM are fused filament fabrication (FFF) or filament 3D printing (FDP), which are considered to be equivalent to FDM. In general, FDM printers use a thermoplastic filament, which is heated to its melting point and then extended, layer by layer, (or in fact filament after filament) to create a three-dimensional object. FDM printers are relatively fast, low cost and can be used for printing complicated 3D objects. Such printers are used in printing various parts and shapes using various polymers for a wide range of applications.

The cover may be light diffusing.

A light diffusing cover may as expected serve to diffuse the LED light and give the light source a yet more even illumination profile. In the case wherein a light diffusing cover is used, the LED emission may be directed, for example by using side- or top-emitting LEDs, parallel to the substrate. In the case wherein a non-diffusing cover is used, such as a transparent cover or a lens or an array thereof, the LED emission may be directed along a normal of the substrate.

The outer side wall may comprise an inner surface that is light reflective.

A reflective side wall may reduce the extent to which light from the LEDs is absorbed by the side wall. It may work similar to having a reflective surface on the first side of the substrate in that more light may be directed out of the light source. By this, the light output of the light source may be increased. A light reflective surface may, also here, lead to less heating of the light source.

The plurality of LEDs may be arranged one after the other in an array.

LEDs arranged in an array along the surface of the heat sink structure may both more evenly spread out the light output as well as more evenly spread out the waste heat being transferred to the heat sink structure. Another advantage, as compared to forming a compact or single LED structure, would be the increased interface area towards the heat sink structure relative to the bulk volume of the LED die, potentially increasing heat transfer from the LEDs to the heat sink structure. Regularly spaced LEDs in an array may be the most advantageous option for light emission and heat dissipation.

According to a second aspect there is provided a lighting system comprising the light source according to the first aspect. The lighting system may further comprise a socket connection, adapted to receive an input current from a power source, and an electronic driving circuit, adapted to transform the input current to a driving current and supply said driving current to the plurality of LEDs.

One use of a light source according to the present disclosure would be indoor general lighting, for example for commercial or domestic use. Lighting systems adapted for such use should be compatible with standard lamp socket connections and standard grid power electricity. The socket connection may enable the lighting system to be mechanically attached and conductively connected to existing electric lamp infrastructure. The electronic driving circuit may transform the input grid power to something more suitable for a LED-based light source.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described as such device may vary. It is also to be understood that the terminology used herein is for purpose of describing particular embodiments only and is not intended to be limiting. It must be noted that, as used in the specification and the appended claim, the articles "a", "an", and "the" are intended to mean that there are one or more of the elements unless the context clearly dictates otherwise. Thus, for example, reference to "a lamp" or "the lamp" may include several devices, and the like. Furthermore, the words "comprising", "including", "containing" and similar wordings does not exclude other elements or steps.

BRIEF DESCRIPTION OF THE DRAWINGS

The above and other aspects of the present invention will now be described in more detail, with reference to the appended drawings showing embodiments of the invention. The figures should not be considered limiting the invention to the specific embodiment; instead they are used for explaining and understanding the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION OF THE EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
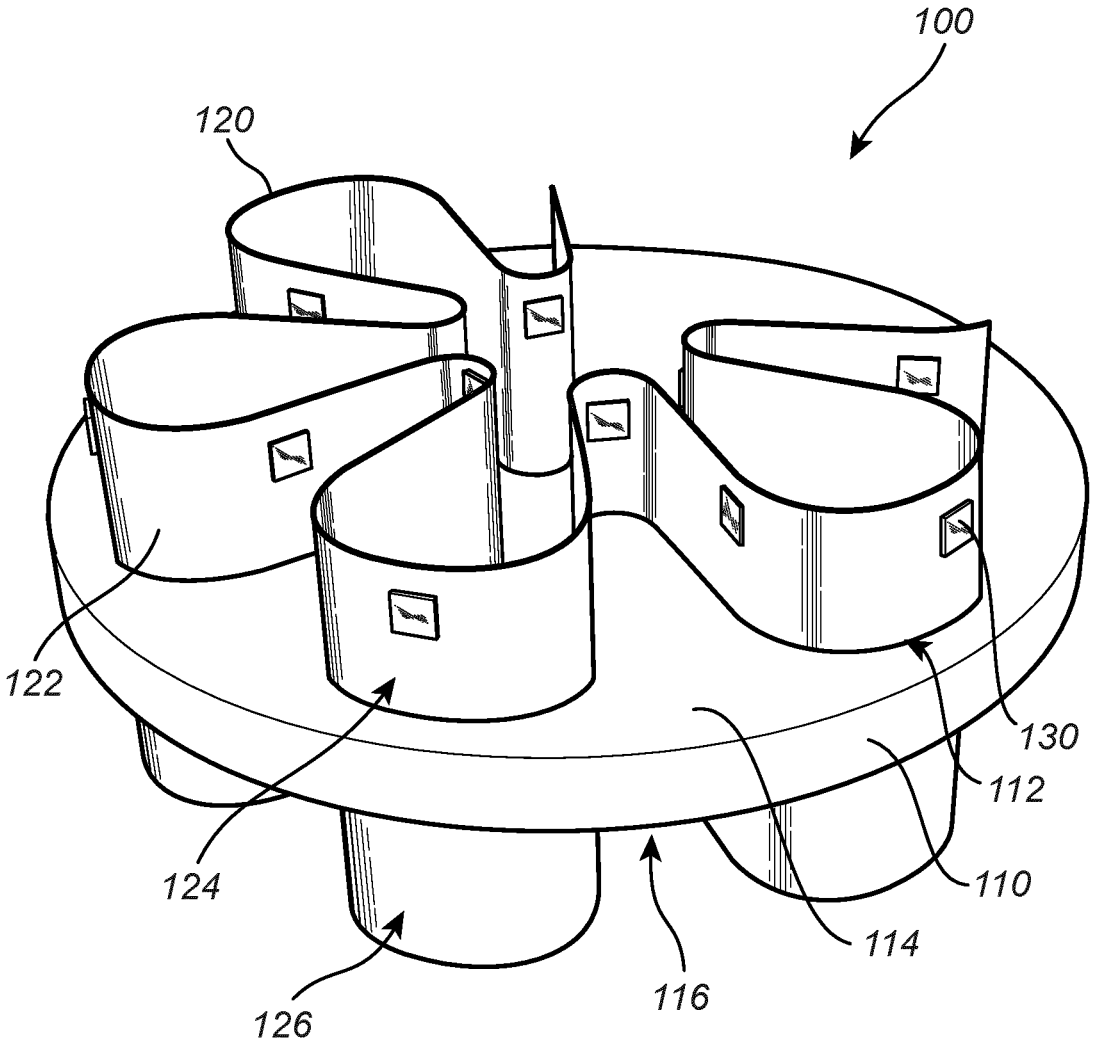
FIG. 1*a* illustrates a light source comprising a substrate and a heat sink structure wherein the heat sink structure is meander shaped.

In FIG. 1*a*, a light source 100 is illustrated. The light source 100 may comprise a flat, circular substrate 110. The proportions of the substrate 110 dimensions may be reminiscent of a coin. The diameter of the substrate 110 may be in the range from 25 to 250 mm. Preferably, the diameter of the substrate 110 is 40 to 60 mm. The substrate 110 comprises a first side 114 and a second side 116. The first side 114 and second side 116 are opposite to each other. The substrate 110 also comprises a slit 112 going through it from the first side 114 to the second side 116. It should be understood that the substrate 110 need not be flat nor circular nor adhere to the suggested dimension range for the inventive concept to work. The slit does not need to be continuous. It may be divided into several parts.

The substrate 110 may comprise a polymer material. The substrate 110 may be formed by FDM. The slit 112 may be defined or formed by the FDM process. The substrate 110 may comprise a light reflective surface on the first side 114. The light reflective surface may be integrally part of the substrate 110 or coated onto it. The light reflective surface may for example comprise a highly reflective polymer such as polycarbonate filled with particles having high refractive index such as titanium oxide (TiOx). Preferably the light reflective surface features a reflectivity greater than 90%, more preferably greater than 93%, and most preferably greater than 95%.

The light source 100 further comprises a sheet formed heat sink structure 120. The heat sink structure 120 is arranged through the slits 112 and extends out from the substrate 110 on the first side 114 and second side 116. The portion of the heat sink structure 120 that extends from the first side 114 of the substrate 110 constitutes a LED comprising portion 124 and the portion that extends from the second side 116 constitutes a heat-emitting portion 126. The heat-emitting portion 126 preferably contains no LEDs 130. The heat sink structure does not need to be continuous it may have several segments. Segments may be electrically connected to each other in series or in parallel. At least part of the LED comprising portion 124 of the heat sink structure 120 may comprise a light reflective layer or surface.

The heat sink structure 120 comprises a plurality of LEDs 130, arranged at a surface 122 of the heat sink structure 120. LEDs 130 may be arranged at the LED comprising portion 122 of the heat sink structure 120. The plurality of LEDs 130 should be considered part of the heat sink structure 120 but note that they are not necessarily formed integrally with the bulk of the heat sink structure 120. In fact, the opposite case with LEDs 130 formed separately from the bulk of the heat sink structure 120 should be understood as preferred. The heat sink structure may comprise a MCPCB. Thus, the LEDs are placed directly on the heat sink structure. Also, it is possible to use a LED strip and glue the LED strip with LEDs onto the heat sink structure.

The heat sink structure 120 may be formed by a bendable metal sheet. The heat sink structure 120 may substantially comprise aluminum or copper. The heat sink structure 120 may also comprise an alloy. It may also comprise a graphite sheet with high in-plane thermal conductivity. The heat sink structure 120 may for example also comprise a polymer featuring highly thermally conductive particles. The heat sink structure 120 may be either elastically or plastically deformed by bending. This may especially be the case if the heat sink structure 120 is formed by a bendable metal sheet.

The heat sink structure 120 may be formed by a rectangular sheet of material. The heat sink structure 120 is preferably elongated with a length (L), a width (W), and a thickness (T). Preferably, $L>10\cdot W$, more preferably, $L>20\cdot W$, and most preferably, $L>30\cdot W$. Preferably, $W>3\cdot T$, more preferably, $W>5\cdot T$, and most preferably, $W>10\cdot T$. Examples of dimensions include L equals 300 mm, W equals 10 mm, and T equals 1 mm.

Figure 1B:
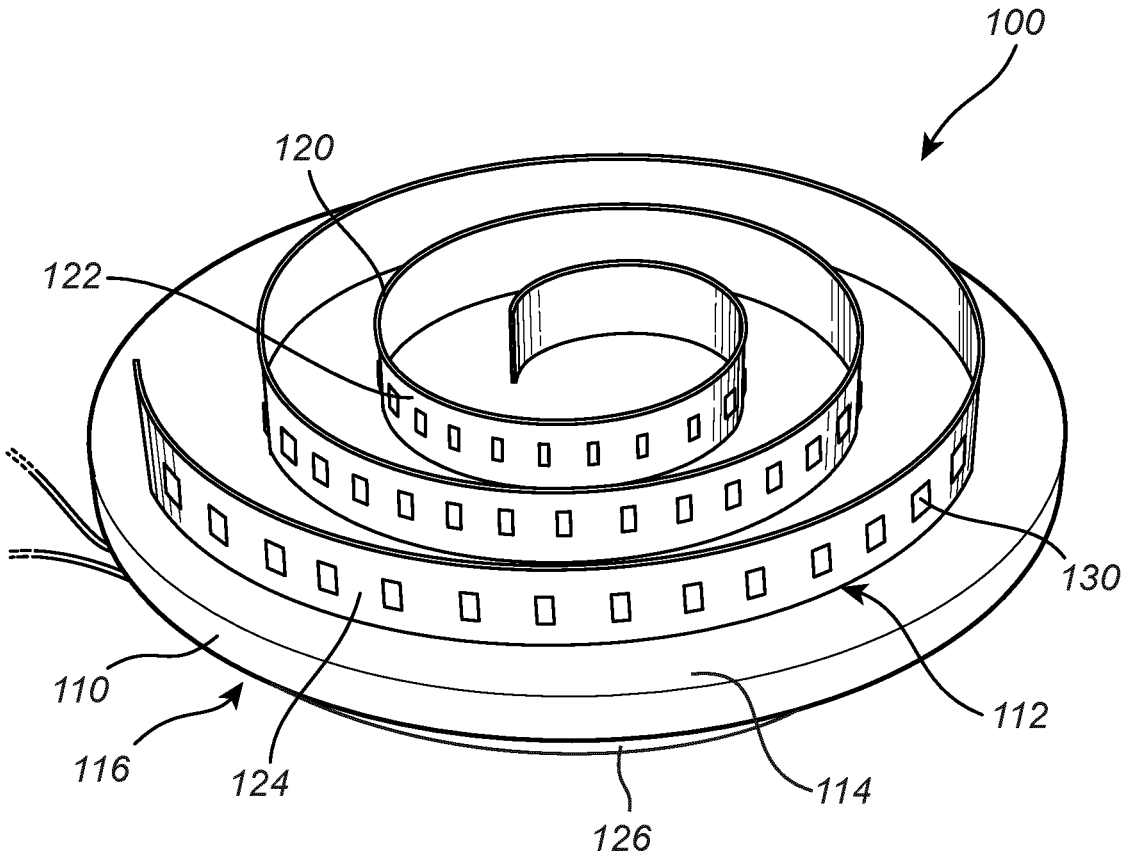
FIG. 1*b* illustrates a light source comprising a substrate and a heat sink structure wherein the heat sink structure is spiral shaped.
Figure 1B:
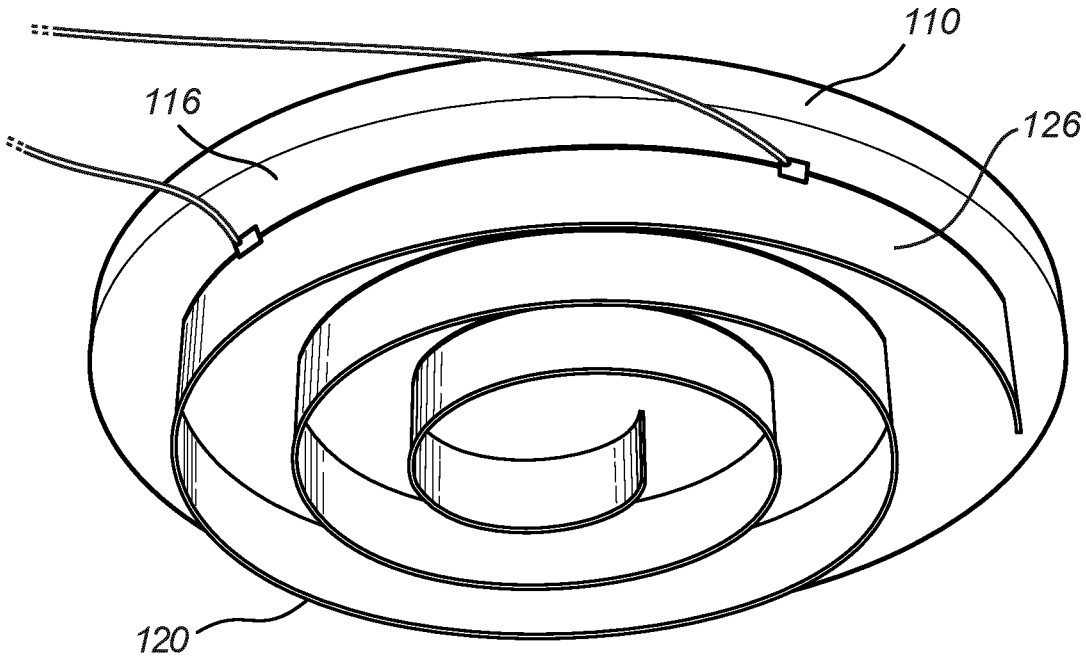

The heat sink structure 120 may for example be prepared by bending to match the slit 112 of the substrate 110 prior to assembly. At least part of the heat-emitting portion 126 of the heat sink structure 120 may be bent towards the substrate 110 post assembly. Also, parts of the LED comprising portion 124 of the heat sink structure 120 may be bent towards the substrate 110. The aforementioned parts may be fully or partially bent towards the substrate 110. The heat sink structure 120 may be cut into smaller segments prior to bending in order to make bending easier. Bending a heat sink structure 120 of non-straight line shapes without cutting into smaller segments may result in overlapping bends. Glues or adhesives may be used for attaching the heat sink structure 120 to the substrate 110. The heat sink structure 120 may also serve as an electrode for connecting LEDs 130. In such a case, the heat sink structure 120 may be conductively connected to via conductive wires as is shown in FIG. 1*b*.

The slit 112, and thus also the heat sink structure 120, may be meander shaped as is shown by FIG. 1*a*. The meander shaped slit 112 and heat sink structure 120 may comprise at least 3 folds, preferably at least 5 folds and more preferably at least 7 folds. For the meander shape, folds may alternate between inward and outward folds. Inward and outward folds may have the same or different radius. Inwards and outward folds may also feature different length. Folds may be part of a regular or an irregular series of folds. Folds may be separated by straight segments of the slit 112, and thus also the heat sink structure 120. In general, more folds enable more area for placing LEDs 130 and heat dissipation. The slit 112 may be formed slightly larger than the heat sink structure 120 in order to let the later thermally expand.

Heat dissipation may be enhanced by cutting out portions of substrate for enabling better flow of air when the device is horizontally oriented. Heat sinking can be further improved by bringing larger heat spreading materials, such as metals or graphite, in thermal contact with the heat emitting portion 126 of the heat sink structure 120.

The thermal conductivity of the heat sink structure 120 may be at least 100 W/m·K, more preferably at least 200 W/m·K, and most preferably at least 250 W/m·K.

Figure 5A:
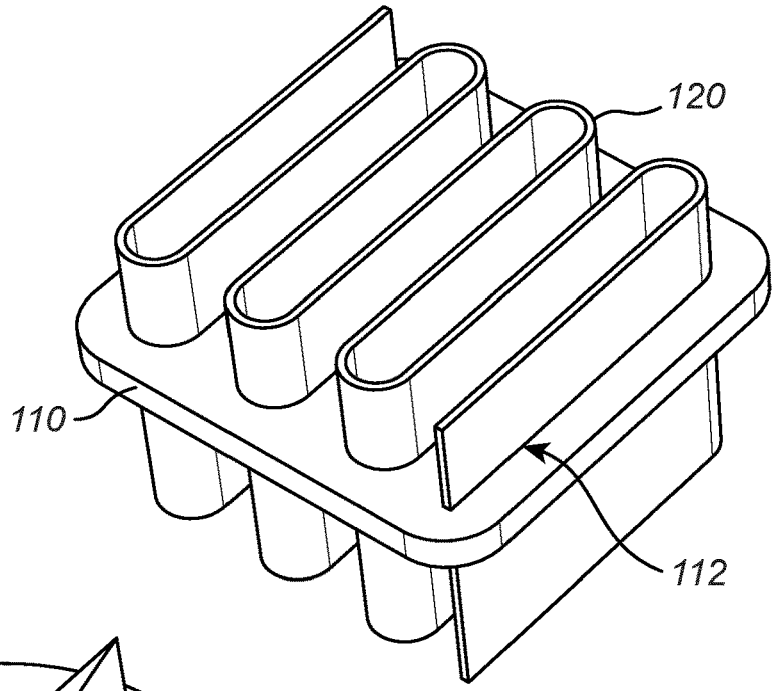
FIG. 5*a* illustrates a light source comprising a substrate and a heat sink structure wherein the heat sink structure is meander shaped.

The particular meander shape shown in FIG. 1*a* features 1:1 alternating inwards-outwards folds wherein the inward folds are longer and have a larger radius than the outward folds. The meander shape formed may be described as a flower shape or a cookie cutter shape. Another shape that may be considered is a meander shape would be a continuous shape comprising a plurality of straight parallel segments connected via folding portions at each end of a segment to a respective adjacent segment. Such a shape, as illustrated by FIG. 5*a*, may provide more area for placing LEDs 130 and improved heat dissipation. FIG. 5*a*, further shows an example of a rounded rectangular substrate 110.

FIG. 1*b* shows an alternative embodiment wherein the slit 112, and thus also the heat sink structure 120, may be spiral shaped. The spiral shape constitutes a continuous inwards fold with a slight but continuous decrease or increase to the radius of the fold. The spiral shaped slit 112 and heat sink structure 120 may comprise at least 3 loops, preferably at least 5 loops and more preferably at least 7 loops. A full 360 degrees rotation around a center point of the spiral shape may constitute one loop. In general, more loops enable more area for placing LEDs 130 and improved heat dissipation. The heat emitting portion 126 of the heat sink structure 120 is preferably covered with a layer featuring high reflectivity for visible light. This may be a coating of a polymer with TiOx. It may further be a highly reflective foil. It may also be a meander shape wall formed during the fabrication of the substrate 110.

Many different variations to the shape of the slit 112, and thus also the heat sink structure 120, may be considered. For example, the meander shape of FIG. 1*a* and the spiral shape of FIG. 1*b* may be combined to create a meander-spiral shape.

Figure 5B:
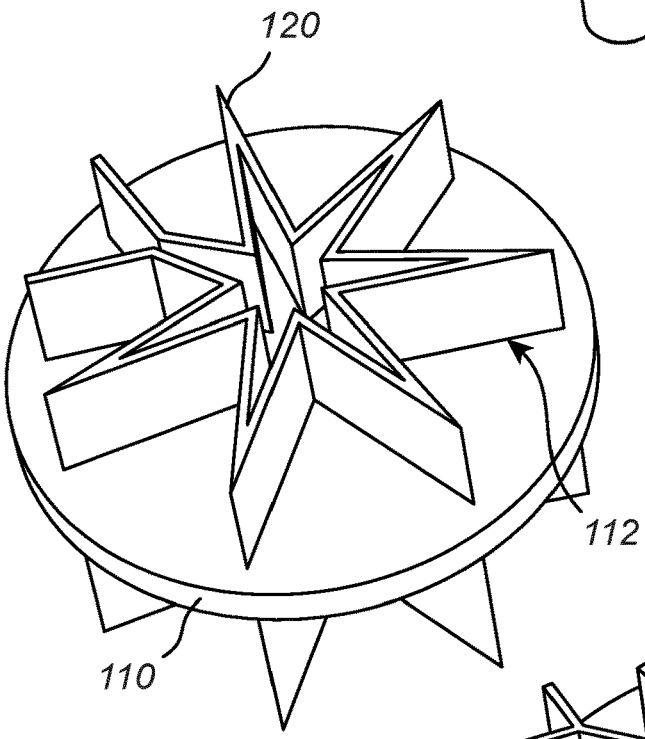
FIG. 5*b* illustrates a light source comprising a substrate and a heat sink structure wherein the heat sink structure is star shaped.
Figure 5C:
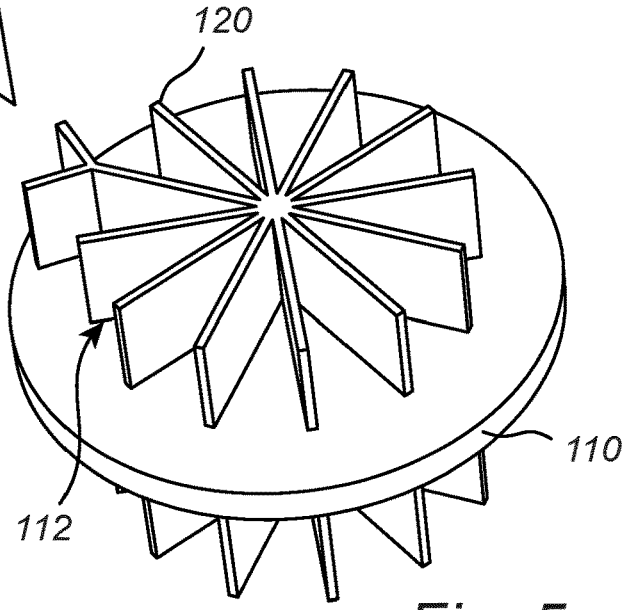
FIG. 5*c* illustrates a light source comprising a substrate and a heat sink structure wherein the heat sink structure is star shaped.

Folds may be sharp as to produce a star shaped heat sink structure 120 as illustrated in FIGS. 5*b* and 5*c*. The slit 112 may be correspondingly shaped, regardless of the shape chosen for the heat sink structure 120. The plurality of LEDs 130 may not be confined to just one surface or side of the heat sink structure 120. LEDs 130 may be arranged proximate to an edge of the LED comprising portion of the heat sink structure. Specifically, LEDs 130 may be arranged near the edge of the LED comprising portion 124 furthest from the substrate 110.

LEDs 130 may be side-emitting LEDs. The LEDs 130 may be made side-emitting by forming them integrally with or to include waveguide structures that may direct the output light in a certain direction. This waveguide may be formed by active or passive semiconductor layers within the LEDs 130 or by encapsulating layers. A side-emitting LED may further include reflectors to direct the output light.

The LEDs 130 may be light sources such as solid state, inorganic LEDs, lasers, or organic LEDs (OLEDs). The LEDs 130 may further be blue LEDs, comprising at least GaN or InGaN semiconductor materials. The LEDs 130 may also comprise a phosphor coating for light spectrum modulation. Such modulation may be used to form white light. Red, green and blue (RGB) LEDs, forming white light by mixing lights of different wavelengths, may also be considered for the plurality of LEDs 130.

Figure 6:
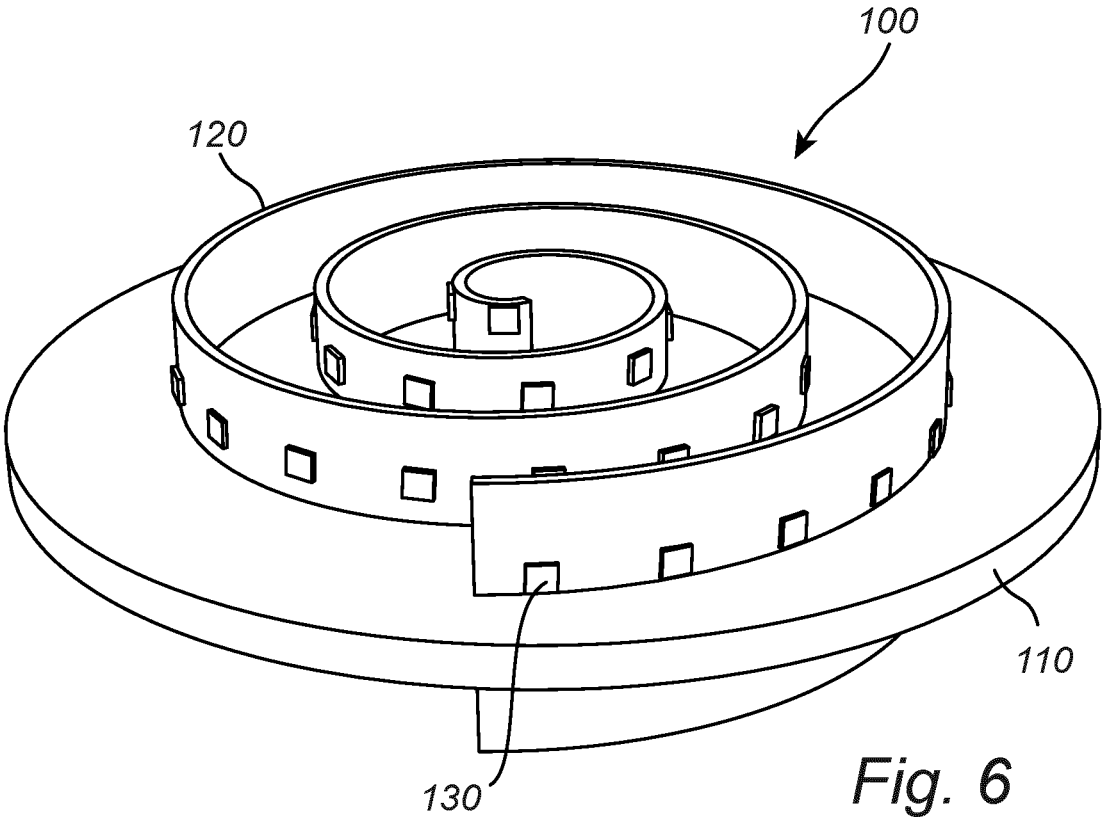
FIG. 6 illustrates a light source comprising a substrate and a heat sink structure wherein the heat sink structure is spiral shaped.

The white light preferably features a color temperature in the range from 2000-8000 K, more preferably 2500-6000 K, and most preferably 2700-5000 K. The white light is preferably within 12 standard deviation color matching (SDCM) units from the black-body line (BBL), more preferably within 7, and most preferably within 5. Preferably the color rendering index (CRI) of the LEDs 130 or light source 100 is larger than 80, more preferably larger than 85, and most preferably larger than 90. The LEDs 130 may be arranged one after the other in an array. The plurality of LEDs 130 may preferably comprise at least 10 LEDs, more preferably at least 15 LEDs, and most preferably at least 20 LEDs. Separate LEDs 130 may be considered and arranged to form the array on the surface 122 of the heat sink structure 120. LEDs 130 may also be connected, mechanically and conductively, on a LED strip. The LED strip may then comprise the array of LEDs 130. The LED strip may comprise a PCB and the LEDs 130 as well as adhering means for attachment to the heat sink structure 120. The PCB may comprise conductive electrode lines connected and supplying an electric voltage to the LEDs 130. Conductive wires may also be considered for conductively connecting the plurality of LEDs 130. The plurality of LEDs may be arranged as a conical spiral meaning that the LEDs 130 are arranged successively further from the substrate 110 towards the center of the spiral as is illustrated by FIG. 6.

The PCB may need to be thin in order for it to be sufficiently bendable. Adhering means may include glues or adhesives, with a melting temperature above 100 degrees Celsius, but more preferably above 150 degrees Celsius, and most preferably above 250 degrees Celsius. Top-emitting LEDs may also be used for the LED array. In order to facilitate efficient emission from top-emitting LEDs a LED strip may be partially bent to protrude from the heat sink 120 structure so that emission may be centered around a normal of the substrate 110. As an alternative to a PCB for the LED strip a thin MCPCB may be used. The LED strip or array may comprise the entire length of the heat sink structure 120.

Typically, LED packages may constitute comprise single or multiple dies emitting at different wavelengths. They may also comprise a phosphor layer. Length and width dimensions may be in the range of 0.5-10 mm. For example, the die of one LED 130 may be 2×3 mm. The use of a single elongated LED 130 may also be considered instead of using a plurality of separate LEDs 130 to further improve light and heat distribution as long as practical considerations allow for such a device to be produced.

Figure 2:
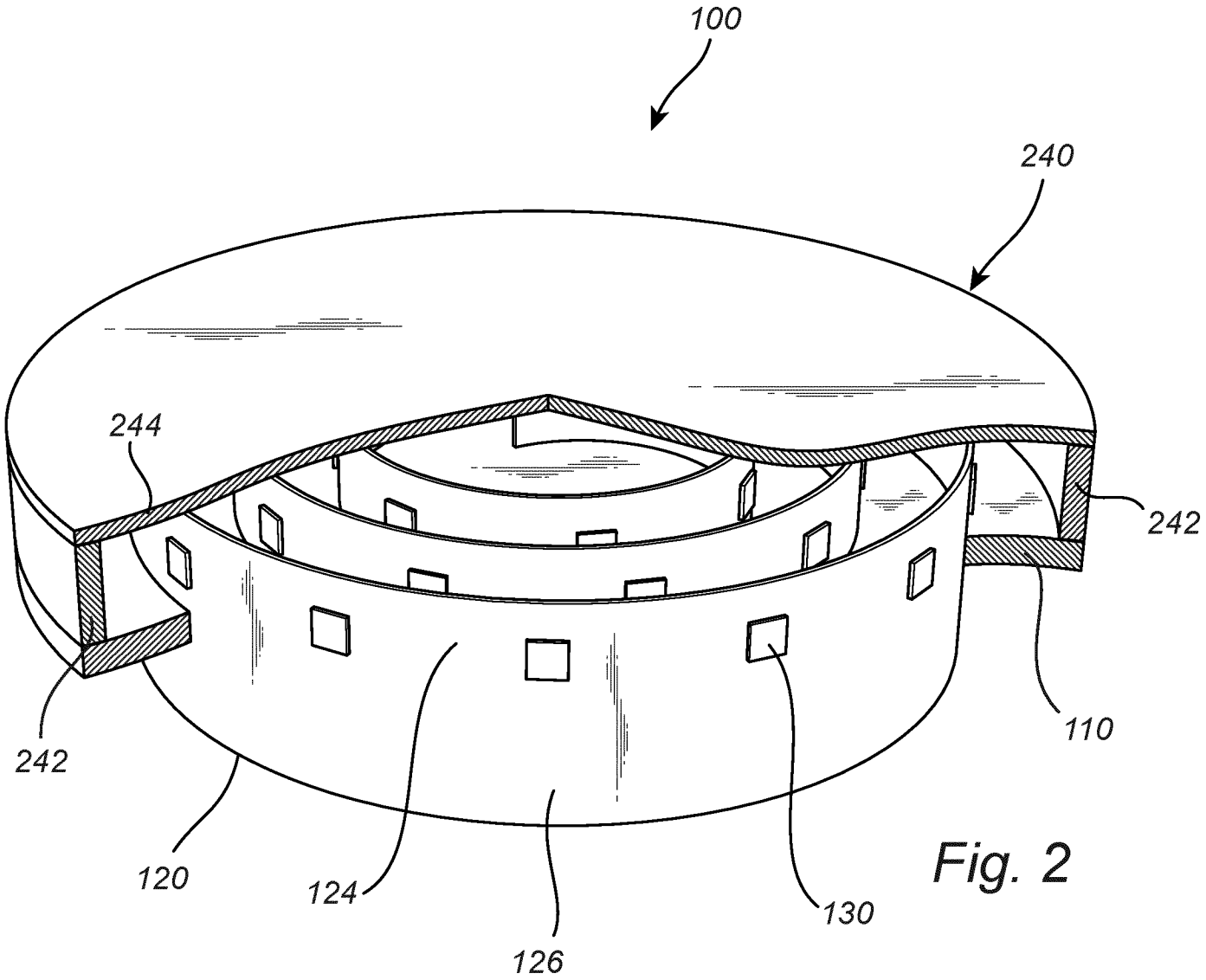
FIG. 2 illustrates a light source comprising a housing of an outer wall and a cover.

In FIG. 2 the light source is shown to include an outer side wall 242 and a cover 244. Together with the substrate 110, these form a housing 240. The LED comprising portion 124 of the heat sink structure 120 is housed within the housing 240 for forming a light mixing chamber. Essentially, the light mixing chamber constitutes the internal volume space defined by the housing 240. The light mixing chamber, and thus also the housing 240, serve to give the light source 100 a more even illumination profile.

The cover 244 may be attached to the outer side wall 242 and/or the heat sink structure 120. The outer side wall 242 may be attached to the substrate 110. Glues or adhesives may be used for attaching the parts of the housing 240. The housing 240 may completely enclose the light mixing chamber. The housing may also leave gaps and openings into the light mixing chamber. The outer side wall 242 may be printed on top of the substrate 110 during manufacturing. It is also possible to print the outer side wall 242 onto the cover 244 and squeeze the substrate 110 into the outer side wall 242 and cover 244 combined parts.

The outer side wall 242 may comprise an inner surface that is light reflective. The inner surface may be integrally part of the outer side wall 242 or coated onto it. The inner surface may comprise a light reflective material, such as TiOx filled polymer. Preferably the outer side wall 242 inner surface features a reflectivity greater than 90%, more preferably greater than 93%, and most preferably greater than 95%. The outer side wall 242 may comprise a polymer material. The outer side wall 242 may be formed by FDM.

The cover 244 may be light diffusing. The cover 244 may comprise a material with intermittent surface features or thickness. An intermittent pattern may be concentrically aligned with the cover. The cover 244 may preferably be semi-reflective. Preferably the reflectivity of the semi-reflective cover 244 is in the range from 30-80% of the light emitted from the LEDs 130, more preferably 35-70%, and most preferably 40-60%.

The cover 244 may also be phosphor coated for modulation of raw blue LED light reducing the amount of package required for individual LEDs 130, further improving heat dissipation. The cover 244 may comprise a polymer material. The cover 244 may be formed by FDM.

Figure 3:
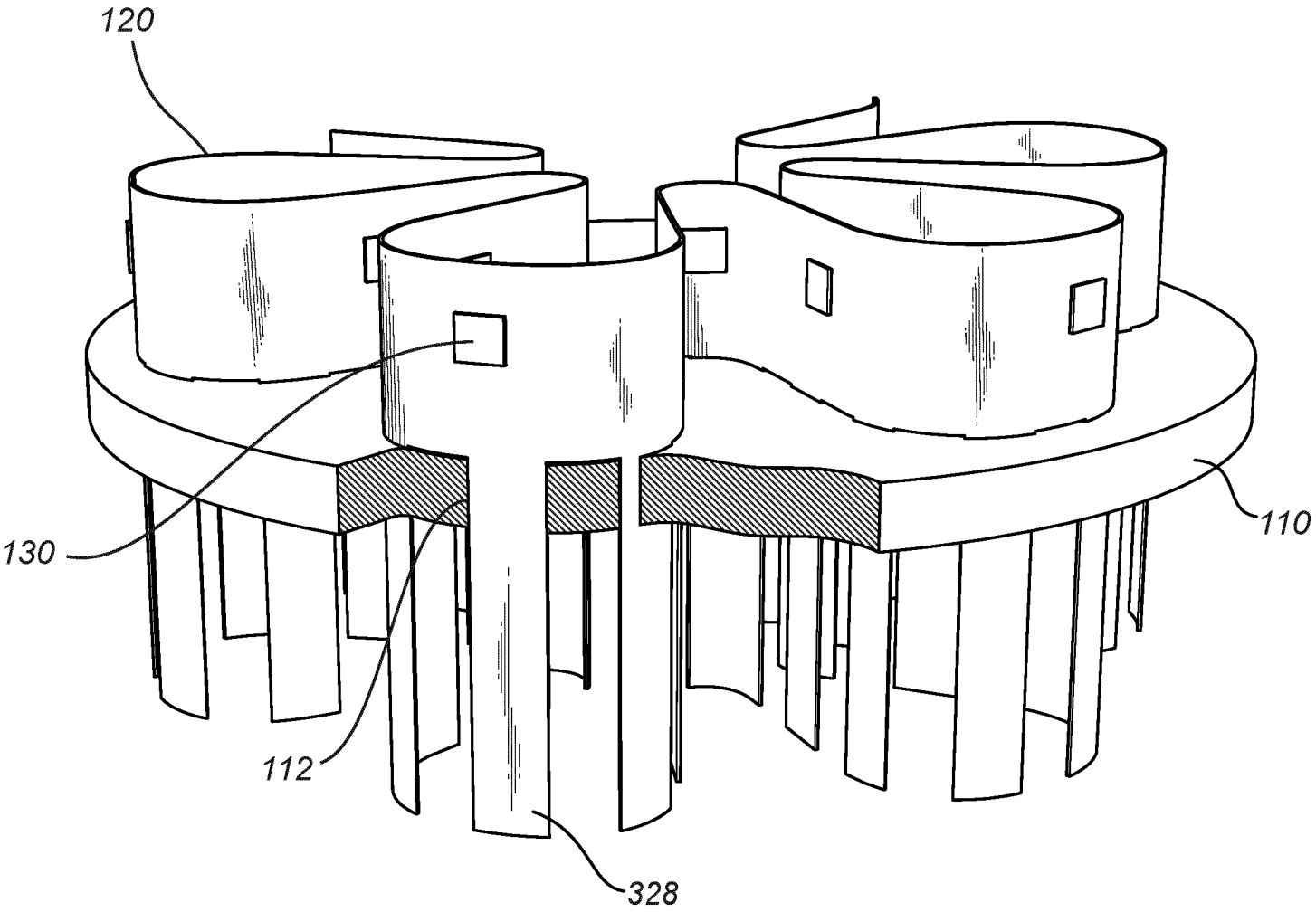
FIG. 3 illustrates a light source whose substrate comprises a plurality of slits and whose heat sink structure comprises a plurality of protrusions.

In FIG. 3 the light source 100 is shown wherein the substrate 110 comprises a plurality of slits 112 and wherein the heat sink structure 120 comprises a plurality of protrusions 328. The protrusions 328 being adapted to extend through the slits 112 of the substrate 110. Protrusions 328 protrude through the substrate 110 from the first side 114 to the second side 114. The heat emitting portion 124 of the heat sink structure 120 may comprise the protrusions 328. Protrusions 328 may be formed by cutting the heat sink structure 120 prior assembling it with the substrate 110. The number of slits 112 may match the number of protrusions 328 but it is not an absolute requirement. The number of slits 112 may preferably be at least 3, more preferably at least 5, and most preferably at least 6. The number of protrusions 328 may preferably be at least 2, more preferably at least 4, and most preferably at least 6. A plurality of slits 112 further allows for a plurality of heat sink structures 120. Separate heat sink structures 120 may then for example be aligned concentrically into corresponding concentric slits 112. Separate heat sink structures 120 may serve as separate electrodes for connecting LEDs 130. A voltage potential difference between the electrodes may, in such a device, be applied to and power the LEDs 130.

Other variations of the shape of the heat sink structure 120 might include circular and elliptical shapes. Several heat sink structures 120 of these shapes with varying dimensions may further be arranged concentrically through corresponding concentric slits 112 of the substrate. This may require a heat sink structure 120 with protrusions 328 as the substrate 110 may be separated into separate, unconnected portions by featuring a slit 112 that connects with itself, for example at its ends. Unconnected portions of the substrate 110 and the heat sink structure 120 may in such a case for example be attached by glues or adhesives.

Figure 4:
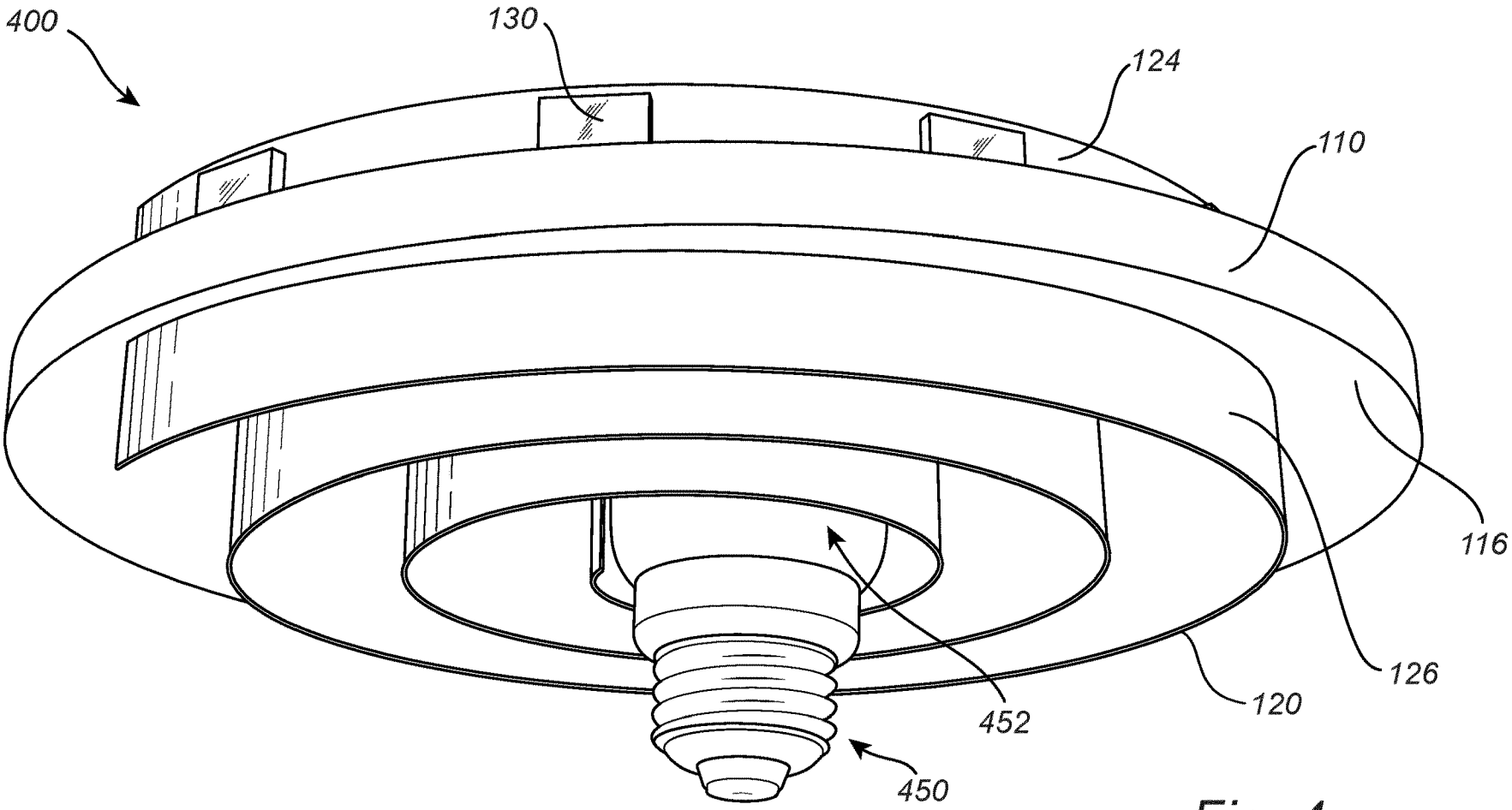
FIG. 4 illustrates a lighting system comprising a light source and a socket connection.

In FIG. 4 a lighting system 400 is shown. The lighting system 400 comprises the light source 100, a socket connection 450 and an electronic driving circuit 452. The socket connection 450 is adapted to receive an input current from a power source. The electronic driving circuit 452 is adapted to transform the input current to a driving current and supply said driving current to the plurality of LEDs 130. A complete lighting system 400 may further comprise a lamp reflector, configured to direct at least part of a light output of the light source 100 and mechanical mounting means, for example for mounting the lighting system 400 to ceiling or a supporting structure. The power source may be an electrochemical source such as a battery or a grid power source such as a standard powered wall plug.

The socket connection 450 may be a standard threaded socket connection. The socket connection 450 serves to mechanically and conductively connect the lighting system 400 to a power source, not part of the system 400. The threads may comprise a first conductive contact while a second conductive contact, insulated from the first conductive contact, may be located at an end portion of the socket connection 450. The lighting system 400 should not be limited to just socket connections as connection means.

The electronic driving circuit 452 may be adapted to transform an input alternating-current with a voltage and frequency of for example 230 V and 50 Hz or 120 V and 60 Hz to a direct-current suitable for driving the LEDs 130. The driving current may have a voltage in the range from 0.5 to 230 V, preferably from 1.5 to 12 V.

The lighting system 400, as well as the light source 100, may be used in a variety of different areas of application, such as indoor lighting, outdoor lighting (streetlamps), vehicular lighting, and industry lighting. Areas of particular interest should include high power/high output applications as well as high, or fluctuating, temperature environments. Further areas of application might be those that require long lifetime or are associated with expensive regular maintenance. The socket connection 450 may only be relevant in some of these cases but in those cases, there may be equivalent means for conductive and mechanical connection. The means for conductive and mechanical connection may also be separated.

Additionally, variations to the disclosed embodiments can be understood and effected by the skilled person in practicing the claimed invention, from a study of the drawings, the disclosure, and the appended claims.

The invention claimed is:

1. A light source comprising:

a plurality of LEDs, a sheet formed heat sink structure having a surface on which the plurality of LEDs is arranged, and a housing, wherein the housing comprises a substrate, an outer side wall and a cover, wherein the substrate has a plurality of slits, wherein the heat sink structure is mounted through the plurality of slits such that a LED comprising portion of the heat sink structure, extending from a first side of the substrate, and heat-emitting portions of the heat sink structure, extending from a second side of the substrate being opposite to the first side, are formed, wherein the LED comprising portion of the heat sink structure is housed within the housing for forming a light mixing chamber, wherein the first side of the substrate comprises a light reflective surface, and wherein the outer side wall of the housing comprises an inner surface that is light reflective.

2. The light source according to claim 1, wherein the plurality of slits, and thus also the heat sink structure, extend in a pattern which is meander shaped or spiral shaped or star shaped.

3. The light source according to claim 2, wherein the pattern, and thus also the heat sink structure, is meander or star shaped and comprises at least 3 folds.

4. The light source according to claim 2, wherein the pattern, and thus also the heat sink structure, is spiral shaped and comprises at least 3 loops.

5. The light source according to claim 1, wherein the heat sink structure is formed by a bendable metal or a graphite sheet.

6. The light source according to claim 1, wherein at least part of the heat-emitting portion of the heat sink structure is bent to match the plurality of slits.

7. The light source according to claim 1, wherein the plurality of LEDs are arranged proximate to an edge of the LED comprising portion of the heat sink structure.

8. The light source according to claim 1, wherein the plurality of LEDs are side-emitting LEDs.

9. The light source according to claim 1, wherein the heat sink structure comprises a plurality of protrusions, the protrusions being adapted to extend through the plurality of slits of the substrate.

10. The light source according to claim 1, wherein the cover is light diffusing.

11. The light source according to claim 1, wherein the plurality of LEDs are arranged one after the other in an array.

12. A lighting system comprising:

the light source according to claim 1;

a socket connection, adapted to receive an input current from a power source; and an electronic driving circuit, adapted to transform the input current to a driving current and supply said driving current to the plurality of LEDs.

* * * * *